United States Patent [19]

Resta et al.

[11] Patent Number: 4,831,946

[45] Date of Patent: May 23, 1989

[54] APPARATUS FOR AUTOMATICALLY FEEDING A CLOTH TO BE QUILTED ON A CLOTH-HOLDER CYLINDER OF A QUILTING MACHINE

[75] Inventors: Rodolfo Resta; Mario Resta; Roberto Resta, all of Faenza, Italy

[73] Assignee: Resta Commerciale S.R.L., Faenza, Italy

[21] Appl. No.: 142,117

[22] Filed: Jan. 7, 1988

[30] Foreign Application Priority Data

Jan. 9, 1987 [IT] Italy ..... 3306 A/87

[51] Int. Cl.[4] ..... D05B 11/00

[52] U.S. Cl. ..... 112/117; 112/118; 112/119

[58] Field of Search ..... 112/117, 118, 119, 102, 112/103, 90, 91, 92, 121.24

[56] References Cited

U.S. PATENT DOCUMENTS 1,937,491 11/1933 May ..... 112/117
1,946,868 2/1934 May ..... 112/118
2,377,951 6/1945 May ..... 112/118
2,490,887 12/1949 Schadt ..... 112/118
4,716,845 1/1988 Codos ..... 112/118

*Primary Examiner*—Ronald Feldbaum
*Attorney, Agent, or Firm*—Guido Modiano; Albert Josif

[57] ABSTRACT

The apparatus includes a pair of hoops constituting said cylinder and provided with hooking elements for fastening the lateral edges of the cloth and mutually connected by longitudinal bars provided with hooking elements for fastening the initial and terminal edges of the cloth. The apparatus further includes a framework guided perpendicularly to the cylinder tangent plane and whereon is slideable a cutting assembly below which are arranged means for elastic retention of the initial flap of the cloth, means being furthermore provided to actuate the framework between a lowered position in which the initial and terminal flaps of the cloth couple to the longitudinal bars and the cloth is cut defining the initial and terminal flaps, and a raised position whereat the cloth-holder cylinder rotates.

8 Claims, 5 Drawing Sheets

APPARATUS FOR AUTOMATICALLY FEEDING A CLOTH TO BE QUILTED ON A CLOTH-HOLDER CYLINDER OF A QUILTING MACHINE

BACKGROUND OF THE INVENTION

The present invention relates to an apparatus for automatically feeding a cloth to be quilted onto a cloth-holder cylinder of a quilting machine.

Quilting machines have been proposed wherein the cloth to be quilted is stretched on a cloth-holder cylinder rotatable about a horizontal axis. For fastening the lateral edges of the cloth, needles are distributed along the circular periphery of the two opposite bases of the cylinder, while the two ends of the cloth, terminal and initial, are fixed to two respective bars which extend between the bases of the cylinder.

In such quilting machines the application of the cloth and its removal from the cylinder are performed manually with considerable loss of time.

SUMMARY OF THE INVENTION

The technical aim of the present invention is to provide an apparatus capable of automating the abovesaid steps of application and removal of the cloth.

This aim is achieved by an apparatus for automatically feeding a cloth to be quilted on a cloth-holder cylinder of a quilting machine, characterized in that hoops constituting said cylinder and rotatably supported along a horizontal axis, said hoops being provided with hooking elements, peripherally distributed, for fastening the lateral edges of the cloth, and mutually connected by longitudinal bars provided with hooking elements for fastening the initial and terminal edges of the cloth, the apparatus further comprising a framework guided in a substantially perpendicular manner with respect to the plane of tangency of the cylinder, wherein is slideable, parallel to the axis of the cylinder, a cutting assembly below which are arranged means for elastic retention of the initial flap of the cloth, means being furthermore provided to actuate said framework between a lowered position in which, at two angularly offset positions of the cloth-holder cylinder, the initial and terminal flaps of the cloth couple to said longitudinal bars as well as the cloth is cut defining said initial and terminal flaps, and a raised position whereat the cloth-holder cylinder rotates.

BRIEF DESCRIPTION OF THE DRAWINGS

Further characteristics of the invention will become apparent from the following description of an embodiment of an apparatus according to the invention, illustrated in the accompanying drawings, wherein.

DESCRIPTION OF THE PREFERRED EMBODIMENTS

Figure 1:
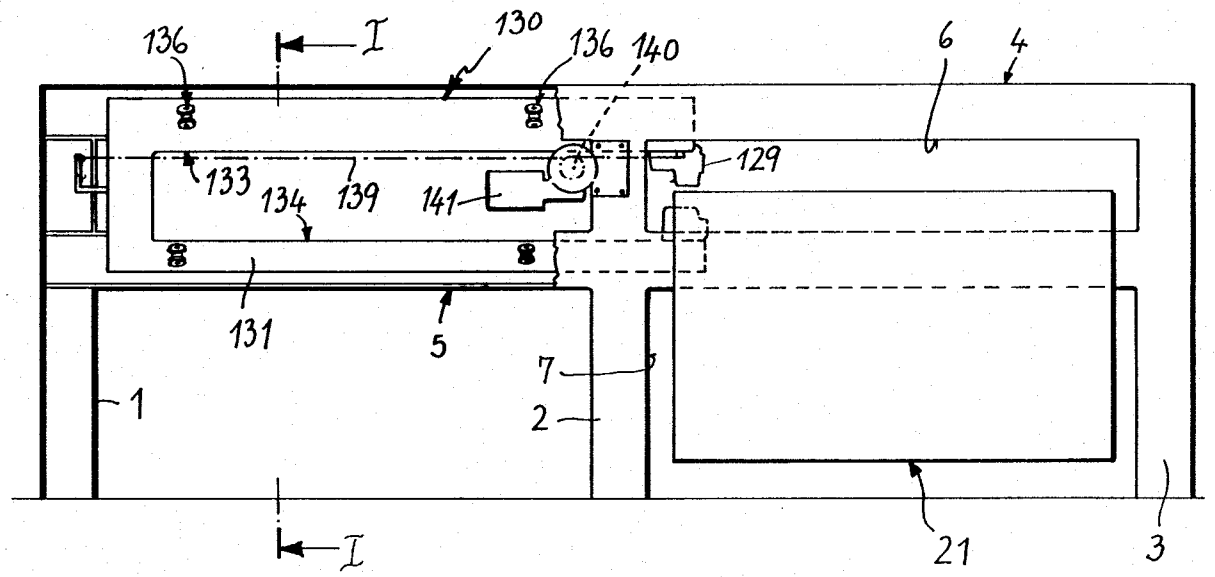
FIG. 1 is a partially schematic elevation view of a quilting machine comprising the apparatus according to the invention.
Figure 1A:
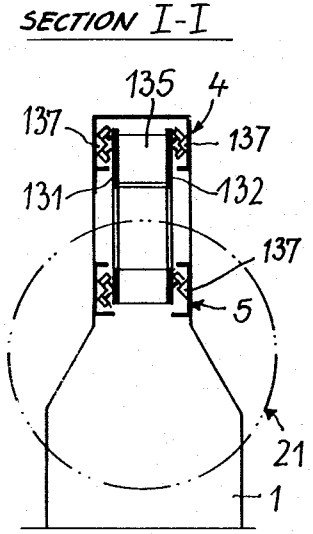
FIG. 1*a* is a view along I—I of FIG. 1.

With reference to above described figures, the quilting machine comprises a frame composed of three columns 1, 2 and 3 which rest on the ground and are connected to one another by an upper beam 4 and by an intermediate beam 5, both horizontal. Two superimposed openings are defined between the beams 4 and 5 and the columns 2 and 3.

The beams 4, 5 are each composed of two members 8, 9 and respectively 10, 11 having cross sections in the shape of counterposed C's.

Between the columns 2 and 3, at the lower opening 7, there extends a horizontal beam 12 with square cross section with the faces inclined at 45° with respect to a vertical plane and provided at the opposite ends with flanges for fixing to the columns 2, 3.

A carriage, generally indicated at 13, guided by a pair of guides 14 fixed on both faces of the beam 5, slides on the beam 12.

Figure 4:
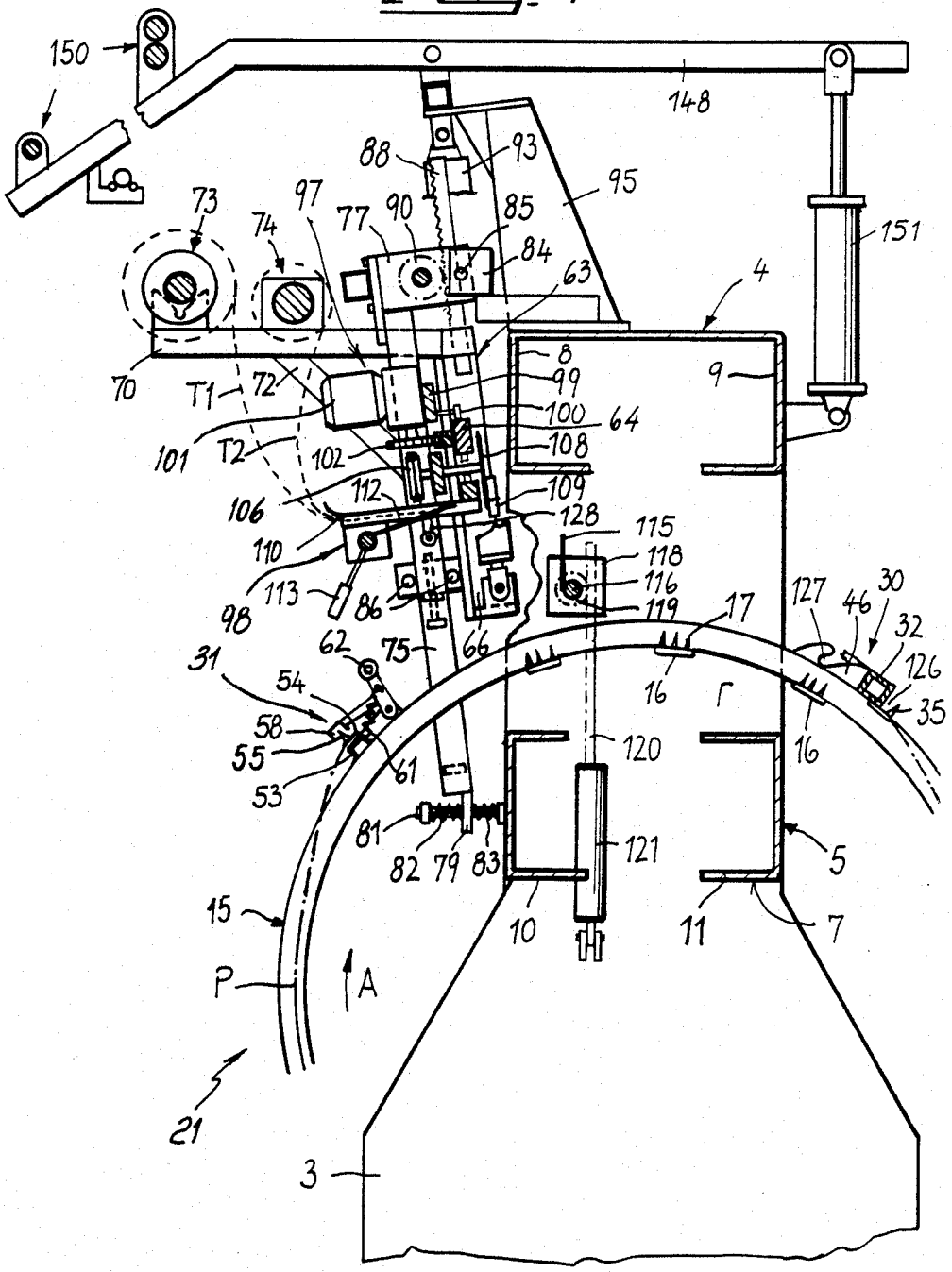
FIG. 4 is a view along the sectional plane IV—IV of FIG. 3.

The carriage 13, by means of rollers, rotatably supports a hoop 15 which, as can be seen in FIG. 4, embraces the beam 5. On the inward face of the hoop 15, that is to say on the face opposite to the one facing the column 3, angularly distributed L-shaped elements 16 are rigidly associated, bearing needles 17, directed radially outwards, which act as hooking element for the edge of the cloth to be quilted. If required the needles 17 can be replaced with suitably shaped clamps.

The other edge of the cloth is hooked by the same number of needles 18 fixed to L-shaped elements 19 which protrude radially outwards from a second hoop 20 coaxial to the hoop 15 and rotatably coupled thereto but axially stationary.

The two hoops 15 and 20 constitute the cloth-holder cylinder or drum 21 of the quilting machine.

For the understanding of the parts more strictly pertinent to the present invention, it is noted that for the rotation of the cloth-holder 21 a reversible motor reducer 22 is provided, having a telescoping shaft 23 at the ends whereof are keyed two pinions 24, 25 which engage with chains 26, 27 wound around the rims of the hoops 15 and 20.

The approaching of the hoops 15 and 20 is achieved by means of a motor reducer 28 which activates a threaded rod 29 which, engaging in a female thread of the carriage 13, determines the movement thereof in one direction or the other.

As described above, while the two lateral edges of the cloth to be quilted are hooked to the needles 17, 18 and to the hoops 15, 20, for the fixing of the terminal and initial edges of the cloth two needle-holder bars 30, 31 are provided which extend longitudinally between the hoops, and each thereof is telescoping.

The needle-holder bar 30, which is the one for fixing the terminal edge of the cloth, is constituted by a tubular profiled element 32 with square cross section, in which there slides a rod 33 also with square cross section, so as to cause a prismatic type rotary coupling. Equally spaced L-shaped elements 34 oriented tangentially with respect to the hoops are rigidly associated with the tubular profiled element 32, and each has a pair of radial needles 35. On the rod 33 a plurality of clamps 36 is fixable, each having a small L-shaped element 37 provided with a pair of needles 38. The clamps 36 are removable and adjustable on the rod 33 to allow the latter to slide in the profiled element 32 when the hoops are moved closer. The coupling of the bar 30 to the hoops 15 and 20 is conceived so as to allow the rotation of the bar about itself for a certain angle and to allow to move the bar along the rim of the hoops according to the length of the cloths to be quilted.

Figure 5:
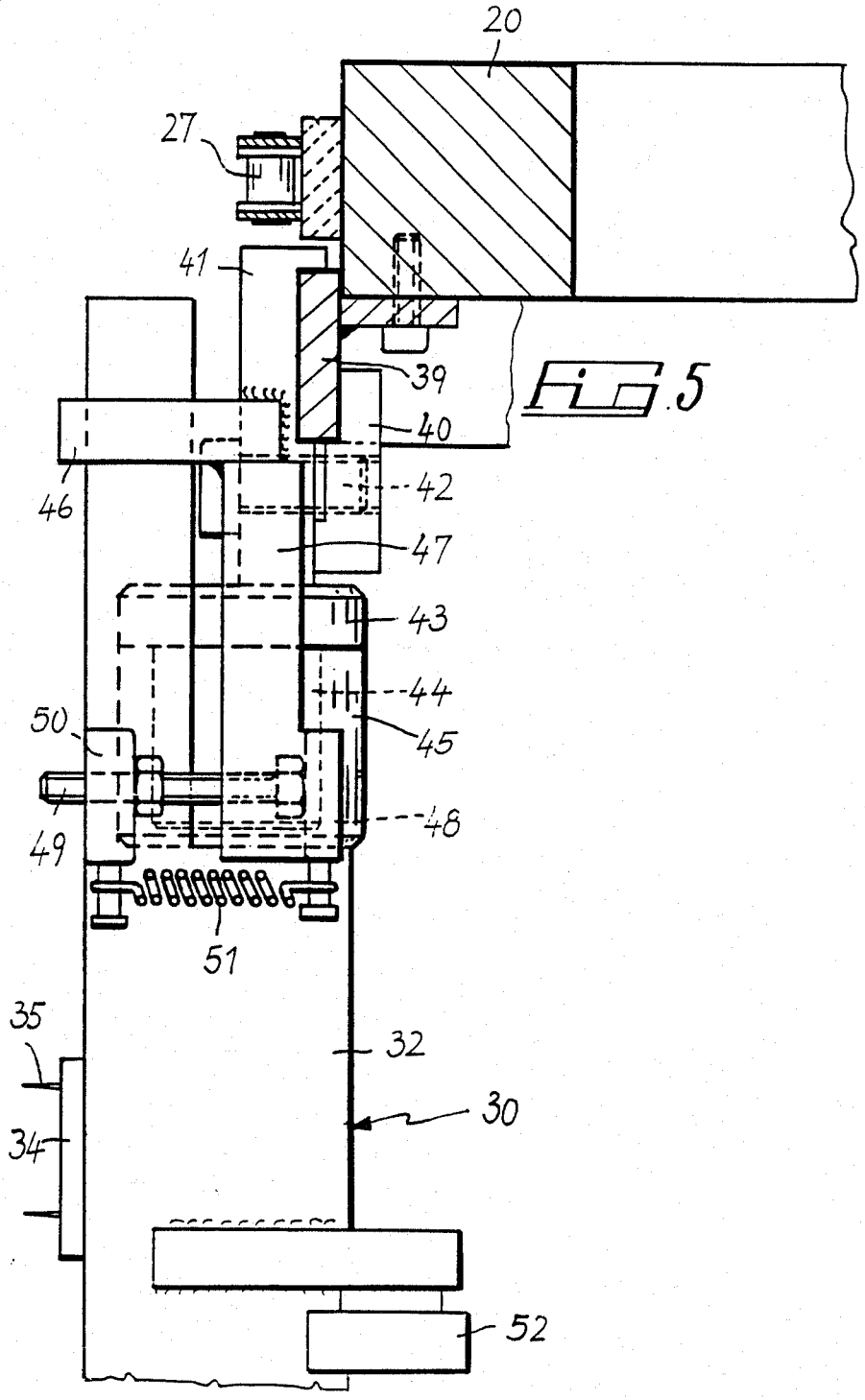
FIG. 5 is a view along the sectional plane V—V of FIG. 2.

For this purpose a ring 39 is rigidly associated with the hoop 20 (see FIG. 5) and protrudces inwards and a clamp composed of two jaws 40, 41 secured to one another by a bolt 42 is fixable thereon. The jaw 41 is rigidly associated with a disk 43 from which there extends a tang 44 rotatably engaged in a bush 45 welded in a recess provided at the head of the profiled element 32. A small plate 46 is rigidly associated with the jaw 41, and a small arm 47 protrudes therefrom, bearing a flap 48 acting as abutment for a screw 49 screwed, in an adjustable manner, in a stud fixed onto the profiled element 32. Between the stud 50 and the flap 48 there acts a traction spring 51 which keeps the screw 49 resting against the flap 48. In this position the needles 35 are perpendicular to the hoop's tangent plant. Naturally the coupling of the rod 33 to the hoop 15 is fully identical to the one just described.

The oscillation of the bar 30 is explained by the need to hook and unhook the needles 35, 38 from the edge of the cloth. This operation is performed in a very precise angular stop position of the cylinder by means of a lever (not illustrated) which, controlled by a jack, acts on a roller 52 arranged on the profiled element 32 and determines the rotation of the bar 30 in contrast with the return action of the springs 51 and, consequently, the lowering of the needles into the rim of the cylinder.

Figure 2:
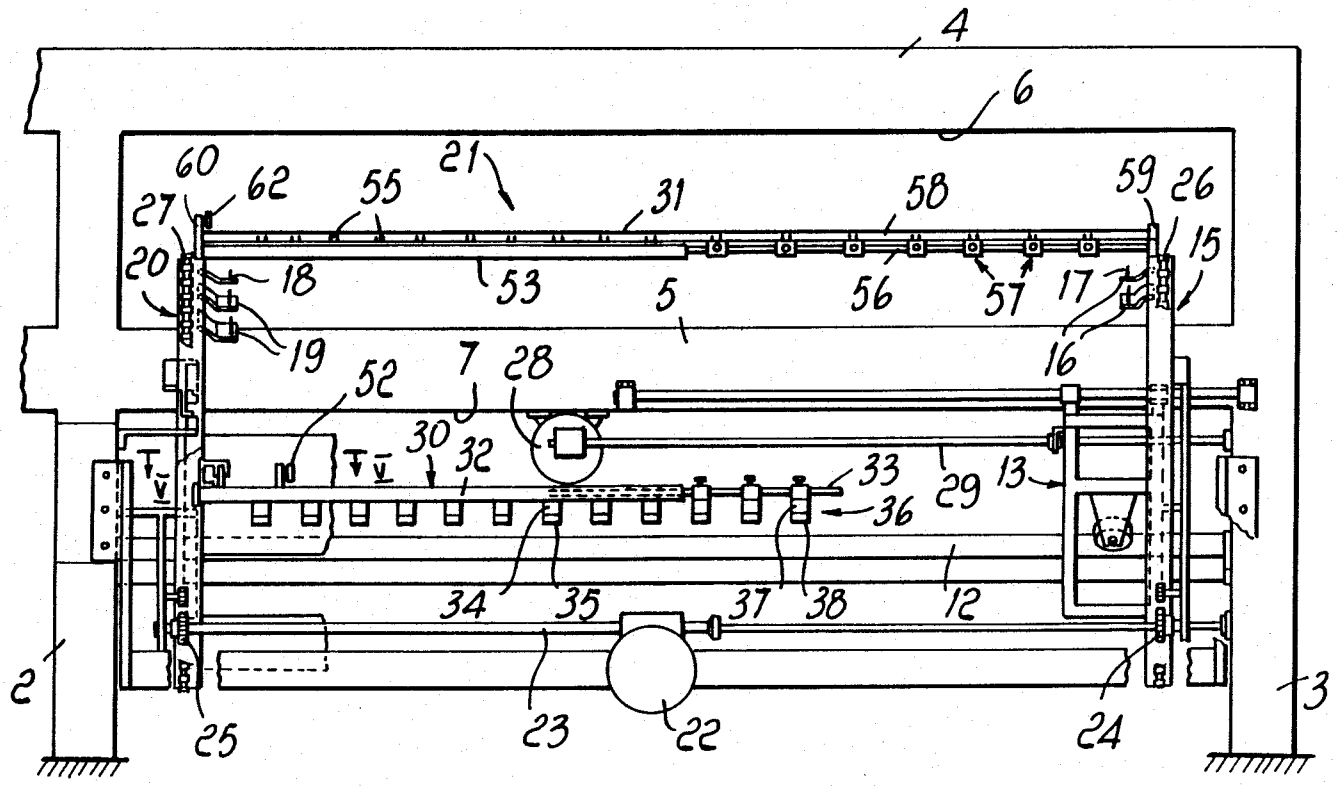
FIG. 2 is an elevation view detailing the part related to the cloth-holder cylinder.

Contrary to the bar 30, the bar 31 for fastening the initial edge of the cloth does not rotate and extends telescopingly between the hoops 15 and 20. The bar 31 comprises a tubular element 53 (see FIGS. 2 and 4) fixed to the hoop 20 and provided with L-shaped elements 54 which bear pairs of needles 55. In the element 53 there is slidable a rod 56 fixed to the hoop 15, whereon needle-holder clamps 57 are locatable, identical to the clamps 36. On the needles 55 there is superimposable an U-shaped profiled element 58, the opposite ends thereof are rigidly associated with respective levers 59, 60. The profiled element 58 is kept, by a spring 61, lowered on the needles so as to lock the edge of the cloth and at the same time provide a protection of the needles 55. The actuation in opening and in closure of the profiled element 58 is controlled by providing on the lever 59 a small roller 62 whereon intervenes a lever articulated to the frame 1 and actuated by a jack. Said lever and jack are not illustrated.

Figure 3:
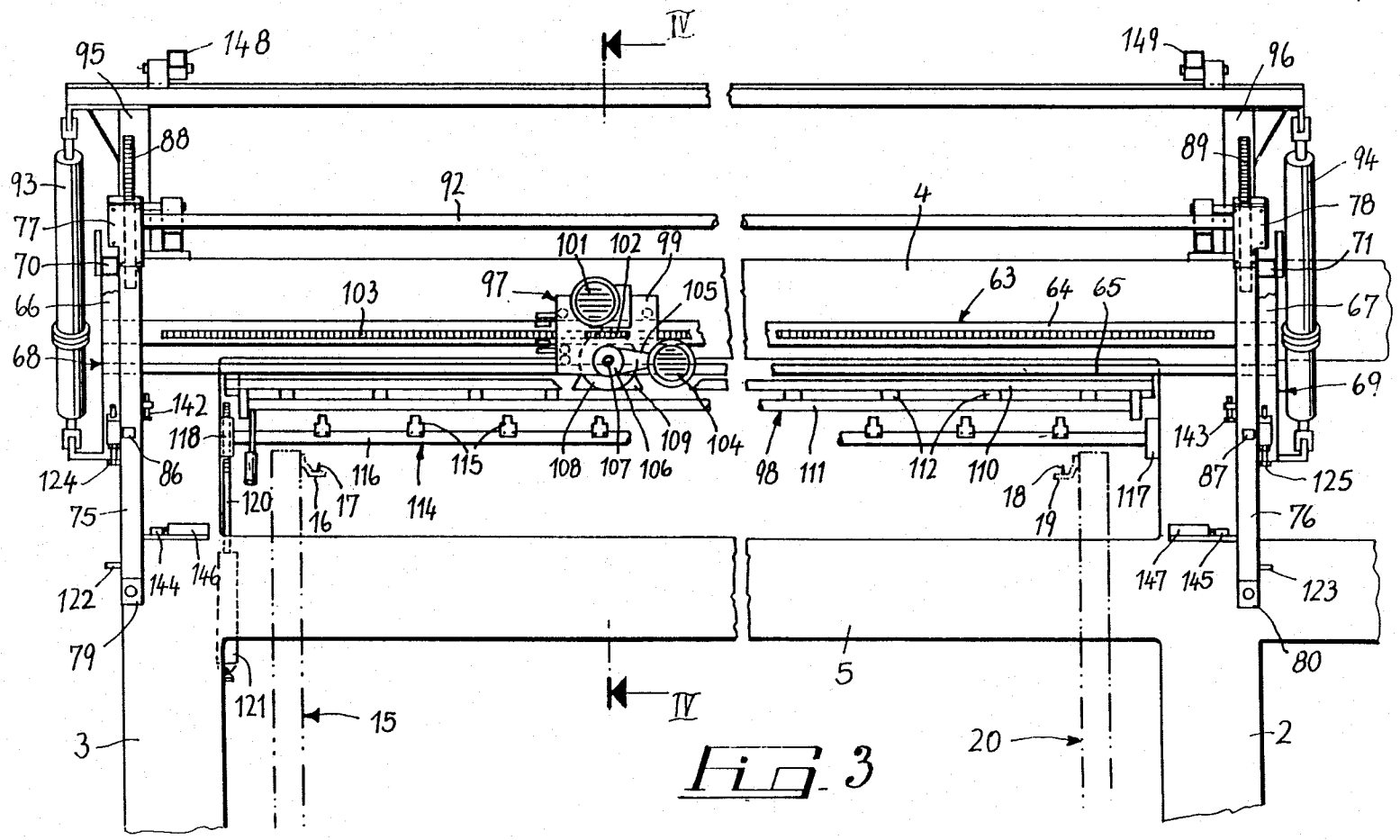
FIG. 3 is an elevation view taken from the side opposite to the one of FIG. 2, illustrating the means for feeding and cutting the cloth to be quilted.

For the application of the cloth to be quilted on the cloth-holding cylinder 21, an apparatus, is provided, illustrated in FIGS. 3 and 4. The apparatus comprises a raisable and lowerable framework 63 composed of two horizontal members 64 and 65 which, with their opposite ends, are rigidly associated with the substantially vertical portions 66, 67 of two triangular brackets 68, 69 perpendicular to the beams 64, 65. Each of the brackets commprises a horizontal arm 70, 71 downwardly the brackets comprises a horizontal arm 70, 71 downwardly propped by a diagonal element which rests on the respective portion 66, 67. In the drawing only the diagonal element 72 related to the ledge 68 is visible.

Various supports 73, 74 are provided on the arms 70, 71 for the rolls of the fabrics which compose the various layers of the cloth to be quilted.

To guide the framework 63 during its upward and downward motion, two columns 75, 76 are provided, with the tops whereof two blocks 77, 78 are rigidly associated, and from the lower ends whereof two flaps 79, 80 provided with eyelets protrude downwards. Through the eyelet of the flap 79 a bolt 81 is driven, screwed frontally into the member 10, on which two springs 82, 83 are arranged which elastically retain the flap 79 in a middle position.

Upwardly, the column 75 is articulated to a protrusion 84 of the beam 4 by means of a pivot 85 which passes through said protrusion and the block 77.

The column 76 is supported on the frame in a fully identical manner so that, by virtue of the mobility allowed by the springs 82, 83, the framework 63 can perform slight angular excursions which allow an exact positioning thereof with respect to the cylinder, according to what will become apparent hereinafter.

For the guiding of the framework 63 along the columns 75, 76, pairs of rollers 86, 87 are provided which are supported below the portions 66,67 of the brackets and roll on the front and rear faces of the columns, as well as stems 88, 89 which extend from the upper ends of the portions 66, 67 parallel to the columns. The stems 88, 89 are guided in seats of the blocks 77, 78 and have racks engaging toothed wheels 90 rotatable in the blocks 77, 78 and mutually rotatably coupled by a shaft 92 which ensures the movement of the framework parallel to itself.

The raising and lowering of the framework are controlled by a pair of jacks 93, 94 having differentiated strokes which, on one side, are coupled in an articulated manner to the lower ends of the portions 66, 67 and, on the other side, to uprights 95, 96 arranged on the upper beam 4 above the columns 2, 3.

The framework 63 supports the assembly 97 for cutting the cloth and the means 98 for the retention thereof.

The cutting assembly or cuttery 97 comprises a small plate 99 adjacent to the plane of the side members 64, 65 and provided with small rollers 100 by means of which it is capable of sliding on said members.

On the plate 99 a motor reducer 101 is frontally mounted, and a pinion 102 is keyed on its output shaft and is constantly engaged, through an opening of the plate 99, with a rack 103 rigidly associated laterally to the member 64.

Below the motor reducer 101, on the plate 99 there is furthermore mounted an electric motor 104 which, by means of a belt 105, motorized a pulley 106 keyed on a shaft 107. The shaft 170 is mounted freely on the plate 99 and extends, rearwardly to the latter, between the two members 64 and 65 with an end whereon a circular blade 108 is keyed. The circular blade protrudes below the member 65 and a skid 109, resting on the cloth during cutting, is arranged adjacent thereto.

The cutter 97, by effect of the motor reducer 101 and of the engagement of the pinion 102 in the rack 103, moves horizontally along the members, while the rotation of the blade 108 determines the cutting of the cloth fed through the retention means 98.

Said retention means are in practice constituted by a plane 110 protrudingly fixed below the side member 65 and protruding forwards below the cutting assembly 97. The front edge of the plane 110 is folded upwards and below the same a rod 111 is rotatably supported. Elastic laminations 112 are rigidly associated with the rod 111 and extend radially reaching proximate to the plane of advancement of the blade. The rod 111, by means of a torsion spring or of a counterweight, not illustrated in the drawing for sake of simplicity, is caused to rotate so that the ends of the laminations 112 rest elastically against the lower face of the plane 110. A lever 113 allows to rotate the rod 111 in contrast with the return means when it is desired to move the laminations 112 away from the plane 110, for example for the introduction of the cloth to be quilted.

A presser element 114 completes the described apparatus, and has the function of pressing the terminal flap of the cloth to be quilted on the needles of the needle-holder bar 30 to ensure a solid hooking. The presser element is constituted by a plurality of tabs 115 fixed radially and equally spaced on a rod 116 rotatably supported in supports 117, 118 rigidly associated with the counterposed faces of the columns 2, 3 which laterally delimit the opening 6.

At the support 118, a spool 119 is rotatably rigidly associated on the rod 116 and engages with a rack 120 actuated by a jack 121 which thus determines the rotation of the tabs between a position of vertical arrangement, illustrated in FIG. 4, and a position of horizontal arrangement in which they press the terminal flap of the cloth on the needles 35 and 38.

The operation of the described apparatus is as follows.

The fabrics T1 and T2 which compose the cloth P, unolled from the respective rolls, are introduced between the plane 110 and the laminations 112 of the retention device which the operator momentarily keeps lowered by means of the lever 113. The cutting assembly 97 is arranged proximate to the column 3 in standby position. The edge of the cloth, suitably trimmed, is positioned so as to project beyond the ends of the laminations 112. Initially the trimming can be performed beforehand manually or by using the cutter 97.

The operating sequence provides that the cloth-holder cylinder 21 be located in stopped condition in such an angular position that the needle-holder bar 31 is arranged on the plane of motion of the framework 63 in opening condition, that is to say with the profiled element 58 raised to leave the needles 55 uncovered.

At this point, by lowering the framework 63 by means of the jacks 93, 94, the initial flap of the formed cloth is applied on the needles 55. The descending stroke of the framework 63 is set by limiters 122, 123 fixed to the columns 75, 76 against which engage adjustable abutments 124, 125 rigidly associated with the vertical portions of the brackets 68, 69.

Once the cloth has been hooked to the needles 55, the rotation in direction A of the cylinder 21 begins and, by effect of the abutment of the small roller 62 against a fixed contrast element of the framework 63, the profiled element 58 is overturned so as to cover the needles 55, and the initial flap of the cloth is retained. Simultaneously the lateral edges of the cloth, as the cylinder 21 rotates, progressively hook onto the needles 17, 18 of the hoops 15, 20 until the needle-holder bar 30 reaches the position previously assumed by the needle-holder bar 31. Once the cylinder 21 is stopped in this angular position, the jack 121 is actuated so that the tabs 115 press on the cloth causing the penetration therein of the needles 35. Naturally the position of the tabs 115 on the rod 116 is selected so that the tabs do not interfere with the needles, when they rest on the cloth.

The framework 63, which during the rotation of the cylinder 21 had been slightly raised so as to not interfere with the cloth, is again lowered until the blade 108 intersects the cylindrical plane of the cloth indicated at P in FIG. 4.

The motor reducer 101 and the electric motor 104 are now activated and determine the advancement of the assembly 97 along the members 64, 65 and the cutting of the cloth. It is provided that during the cutting step the blade advances along the channel 126 defined between the profiled element 32 and the needles 35 so that, while the terminal flap of the cloth remains hooked to the needles 35, the adjacent flap remains free and retained between the plane 110 and the laminations 112 to follow the framework 63 during the subsequent raising.

It should be noted that the considerable dimensions in length of the framework 63 or the variations in the angular stopping position of the cylinders 21, as an effect of different loads and of the intervening plays, can cause even considerable displacements between the position of the blade at one end of the framework and the one at the opposite end or between the position of the blade and the channel 126. In these conditions it can occur that the plane of advancement of the blade is not perfectly centered with respect to the channel 126 in which it must slide. To avoid collisions between the blade 108 and the needle-holder bar 30, notches 127 are provided on the small plates 46 (see FIG. 4) cooperating with appropriate references 138 in the form of rollers which protrude downwards from the plane 110. The small rollers 128, when the framework 63 is lowered, engage in the notches 127 and correct the position of the framework 63 by virtue of the elasticity with which the lower ends of the columns 75, 76 are retained between the springs 82, 83 and of the articulation of the columns to the pivots 85.

As can be seen, a cloth cut each time to size is winded on the cylinder 21. For the execution of the quilting of the cloth stretched on the cylinder, a sewing head 129 is provided, linearly movable along a generatrix of the cylinder. The sewing head is supported by a slider 130 slideable between the members 8-11 and constituted by a pair of shoulders 131, 132 which have two horizontal superimposed C-shaped portions 133, 134 mutually connected by transverse stiffening ribs 135. Pairs of rollers 136 for the sliding of the slider on rails 137 fixed inside the members are mounted laterally on the shoulders 131, 132.

The upper portion 133 of the slider moves above the cloth stretched on the cylinder, while the lower portion 134 enters the hoop 20 and moves below the cloth. The sewing head 129 and the so-called "crochet[ device which cooperates with the sewing head for the execution of the stitches are mounted at the ends of the portions 133, 134.

A chain 139 is fixed to the slider 130, parallel to its sliding direction, and it engages a pinion 140 of a motor reducer 141 flanged on the column 2. The actuation of the motor reducer 141 causes the linear movement of the slider 130 and therefore of the sewing head 129 with respect to the cloth, which movement, with the rotation of the cylinder 21 by means of the motor reducer 22, allows the execution of sewings with any trajectory. Advantageously the motor reducers 141 and 22 are controlled by a programmed processor.

An advantage of the apparatus resides in the possibility of its rapidly adaptation to the dimensions of the cloths to be quilted. In fact, while the distance of the hoops 15, 20 can be varied by activating the motor reducer 28 according to the width of the cloth, the adaptation to the length can be easily obtained by moving the needleholder bar 30 on the hoops after acting on the bolts 42 which slacken and tighten the clamps 40, 41.

A further advantage of the apparatus according to the invention resides in the face that the cloth is perfectly taut on the cylinder. In particular the elastic retention ffect exerted by the element 98 determines, during the rotation of the cylinder 21, the tensioning in the rotational direction, while the tensioning in the axial direction is achieved by moving mutually apart the two hoops 15, 20.

If it is desired to provide a diversified descent stroke for the framework 63, adjustable abutments 142, 143 are rigidly associated with the vertical portions 66, 67, cooperating with stops 144, 145 made retractable by means of jacks 146, 147 mounted on brackets rigidly associated with the columns 75, 76. The jacks 146, 147 remove the stops 144, 145 from the position of interference with the abutments 142, 143 when the descent stroke of the framework is defined by the abutments 122, 123.

In the practical embodiment of the invention, numerous modifications and variations are provided, all within the scope of the following claims. For example it is possible to provide further means of support for supplementary rollers of fabrics for the forming of the cloth to be quilted.

Said means comprise a pair of rockers 148, 149 articulated to the top of the uprights 94, 95 the arms whereof are equipped with roll-holder supports 150 and can be raised and lowered by means of jacks 151.

The materials, as well as the dimensions, may be any according to the requirements and the state of the art.

We claim:

1. Apparatus for automatically feeding cloth to a quilting machine comprising:

a carriage, a cloth holder cylinder said cloth cylinder comprising, at least one pair of hoops, means for rotatably supporting on said carriage, said hoops, so as to allow said hoops to rotate around a horizontal axis of said cloth holder cylinder, horizontal bars to connect the first hoop of said pair to the second hoop of said pair, hooking elements both on said hoops and on said horizontal bars, said hooking elements being periferically arranged so as to be distributed on said hoops and to fasten the lateral edges of said cloth, further hooking elements arranged at each end of said horizontal bars so as to fasten the initial and terminal edges of said cloth, a framework extending above and below said cloth holding cylinder to supply said cloth to said cloth holding cylinder, said framework comprising, two horizontally members and two substantially vertical members, a pair of horizontal arms and a pair of diagonal elements associated to the upper part of said framework to support various cloth rolls, jack means arranged on said guiding columns to actuate said framework between a lowered position in which, at two angularly offset positions of said cloth-holder cylinder, whereat the initial and terminal flaps of the cloth are coupling to said horizontal bars and the cloth is cut defining said initial and terminal flaps, and a raised position whereat said cloth-holder cylinder rotates and horizontal sliding members parallel to the axis of the cylinder and acting as sliding rails for a cutting assembly, the opposite ends of said sliding members being rigidly associated with brackets guided on columns substantially perpendicular to the plane of tangency of the cylinder, said brackets being provided with supports for the rolls of the fabrics which form the cloth.

2. Apparatus according to claim 1, wherein said means for the elastic retention of the initial flap of the cloth are constituted by a plane rigidly associated with said framework and by elastic laminations rigidly associated radially with a rod which extends below said plane, said rod being caused to rotate so that the ends of the laminations rest elastically against said plane.

3. Apparatus according to claim 1, wherein said cutting assembly comprises a plate provided with rollers or sliding on said horizontal sliding members, a motor reducer mounted on said plate and having a pinion which engages with a rack fixed on one of said horizontal sliding members, and an electric motor also mounted on said plate which, by means of a transmission with belt and pulley, actuates a circular blade which intersects said plane of the retention elements.

4. Apparatus according to claim 1, wherein said columns have their upper end articulated to the frame and the lower end elastically retained, and in that the framework is provided with references (rollers) which, during the lowering step, are adapted to engage in notches of the hoops to provide the alignment of the blade with the cutting plane.

5. Apparatus according to claim 1, wherein the framework is actuated by jacks with differentiated framework lowering strokes.

6. Apparatus according to claim 1, comprising a presser element to press the terminal flap of the cloth on the respective bar, said presser element being contstituted by a rod parallel to the axis of the cylinder on which elastic tabs are radially rigidly associated and rotatably actuatable by a jack by means of a pinion and rack transmission.

7. Apparatus according to claim 1, wherein the longitudinal bars are constituted by a tubular profiled element in which a rod is telescopically guided which bears, in a removable manner, clamps provided with elements for the hooking of the cloth.

8. Apparatus according to claim 1, comprising a sewing head mounted on the upper portions of a C-shaped slider, guided parallel to the axis of the cloth-holder cylinder so that the lower portion of the slider, bearing the "crochet" device, penetrates through a hoop of the cylinder.

* * * * *